US012465147B2

(12) United States Patent
Liu et al.

(10) Patent No.: US 12,465,147 B2
(45) Date of Patent: Nov. 11, 2025

(54) CHAIR BASE WITH RETRACTABLE FOOT SUPPORT

(71) Applicant: MOTOMOTION CHINA CORPORATION, Changzhou (CN)

(72) Inventors: Chih Hsiung Liu, Benoni (ZA); Changhua Wang, Changzhou (CN)

(73) Assignee: MOTOMOTION CHINA CORPORATION, Changzhou (CN)

( * ) Notice: Subject to any disclaimer, the term of this patent is extended or adjusted under 35 U.S.C. 154(b) by 144 days.

(21) Appl. No.: 18/228,987

(22) Filed: Aug. 1, 2023

(65) Prior Publication Data

US 2025/0040717 A1 Feb. 6, 2025

(51) Int. Cl.
*A47C 7/50* (2006.01)

(52) U.S. Cl.
CPC ..... *A47C 7/506* (2013.01); *A47C 7/5062* (2018.08)

(58) Field of Classification Search
CPC ..... A47C 7/506; A47C 7/5062
USPC ..... 297/423.2
See application file for complete search history.

(56) References Cited

U.S. PATENT DOCUMENTS

| | | | | |
|---|---|---|---|---|
| 3,902,758 | A * | 9/1975 | Pivacek | A61G 5/12 297/423.22 |
| 6,692,078 | B2 * | 2/2004 | Pham | A47C 1/0342 297/423.2 X |
| 10,098,472 | B2 * | 10/2018 | Khandrika | A61G 7/0514 |
| 10,369,066 | B2 * | 8/2019 | Spence | A61G 5/1059 |
| 10,631,652 | B2 * | 4/2020 | Mackert | A47C 7/5062 |
| 10,709,253 | B2 * | 7/2020 | Khandrika | A61G 7/0506 |
| 10,869,555 | B2 * | 12/2020 | Jones | A47C 7/5062 |
| 2007/0024101 | A1 * | 2/2007 | Hsieh | A47C 7/506 297/423.19 |
| 2007/0252422 | A1 * | 11/2007 | Beaver | A47C 7/506 297/423.24 |
| 2020/0197259 | A1 * | 6/2020 | Estrada | A47C 1/11 |

FOREIGN PATENT DOCUMENTS

| | | | | |
|---|---|---|---|---|
| CN | 113288605 A | * | 8/2021 | A47C 1/0342 |
| GB | 2588772 A | * | 5/2021 | A47C 1/022 |
| KR | 2023130348 A | * | 9/2023 | A47C 1/022 |

* cited by examiner

*Primary Examiner* — Rodney B White
(74) *Attorney, Agent, or Firm* — LAW OFFICES OF STEVEN W. WEINRIEB

(57) ABSTRACT

A chair having a chair base comprises a retractable foot support which is movable between a fully retracted or stowed position at which the foot support is disposed beneath the chair base framework, and a fully extended or deployed position at which the retractable foot support projects outwardly from the chair base framework so as to be disposed in front of the chair. In this manner, the retractable foot support is able to comfortably support the feet of a person seated within the chair when the chair is stationary, as well as to comfortably support the feet of the person seated within the chair when the chair is being moved from one location to another location.

14 Claims, 4 Drawing Sheets

CHAIR BASE WITH RETRACTABLE FOOT SUPPORT

FIELD OF THE INVENTION

The present invention relates generally to chairs, or other similar furniture pieces, and more particularly to a chair base which is provided with a powered, retractable foot support so as to comfortably support a person's legs when the person is seated within the chair or similar furniture piece.

BACKGROUND OF THE INVENTION

When a person sits in a chair, or similar furniture piece, the person's feet usually engage the floor upon which the chair or furniture piece is disposed. Sometimes, however, the person's legs may not be long enough to permit the person's feet to engage the floor and thereby be properly and comfortably supported. Alternatively, a person may be seated within a chair, and it is desired to move the chair from one location to another while the person remains seated within the chair. In this instance, the person must lift and maintain his or her legs above the floor so that the chair can in fact be moved without any interference being generated between the person's feet and the floor. However, it is sometimes difficult and uncomfortable for a particular person to lift his or her legs and to maintain his or her legs elevated for any period of time so that the chair can in fact be moved without any interference being generated between the person's feet and the floor.

A need therefore exists in the art for a new and improved chair. An additional need exists in the art for a new and improved chair base for a chair. Another need exists in the art for a new and improved chair/chair base wherein a foot support is operatively mounted upon the chair. Still another need exists in the art for a new and improved chair/chair base wherein a foot support is operatively mounted upon the chair so as to comfortably support a person's feet when the person is seated within the chair. Yet still another need exists in the art for a new and improved chair/chair base wherein a foot support is operatively mounted upon the chair so as to comfortably support a person's feet when the person is seated within the chair while the chair is stationary, and when the person is seated within the chair when the chair is being moved from one location to another location. Still yet another need exists in the art for a new and improved chair/chair base wherein a foot support is operatively mounted upon the chair, and wherein the foot support is movable between a retracted or stowed position beneath the chair, and an extended or deployed position extending outwardly from the front of the chair, so as to comfortably support a person's feet when the person is seated within the chair while the chair is stationary, and to comfortably support the person's feet when the person is seated within the chair while the chair is being moved from one location to another location.

A further need exists in the art for a new and improved chair/chair base wherein a foot support is operatively mounted upon the chair, and wherein the foot support is movable between a retracted or stowed position beneath the chair, and an extended or deployed position extending outwardly from the front of the chair, so as to comfortably support a person's feet when the person is seated within the chair while the chair is stationary, and to comfortably support the person's feet when the person is seated within the chair, while the chair is being moved from one location to another location, such that the person's feet do not engage the floor. A still further need exists in the art for a new and improved chair/chase base wherein a foot support is operatively mounted upon the chair, and wherein the foot support is movable between a retracted or stowed position beneath the chair, and an extended or deployed position extending outwardly from the front of the chair, so as to comfortably support a person's feet when the person is seated within the chair while the chair is stationary, and to comfortably support the person's feet when the person is seated within the chair, while the chair is being moved from one location to another location, such that the person's feet do not engage the floor whereby the person's feet will not interfere with or impede the movement of the chair along the floor as it is moved from one location to another location.

OVERALL OBJECTIVES OF THE INVENTION

An overall objective of the present invention is to provide a new and improved chair. An additional overall objective of the present invention is to provide a new and improved chair base for a chair. Another overall objective of the present invention is to provide a new and improved chair/chair base wherein a foot support is operatively mounted upon the chair. Still another overall objective of the present invention is to provide a new and improved chair/chair base wherein a foot support is operatively mounted upon the chair so as to comfortably support a person's feet when the person is seated within the chair. Yet still another overall objective of the present invention is to provide a new and improved chair/chair base wherein a foot support is operatively mounted upon the chair so as to comfortably support a person's feet when the person is seated within the chair while the chair is stationary, and when the person is seated within the chair when the chair is being moved from one location to another location. Still yet another overall objective of the present invention is to provide a new and improved chair/chair base wherein a foot support is operatively mounted upon the chair, and wherein the foot support is movable between a retracted or stowed position beneath the chair, and an extended or deployed position extending outwardly from the front of the chair, so as to comfortably support a person's feet when the person is seated within the chair while the chair is stationary, and to comfortably support the person's feet when the person is seated within the chair while the chair is being moved from one location to another location. A further overall objective of the present invention is to provide a new and improved chair/chair base wherein a foot support is operatively mounted upon the chair, and wherein the foot support is movable between a retracted or stowed position beneath the chair, and an extended or deployed position extending outwardly from the front of the chair, so as to comfortably support a person's feet when the person is seated within the chair while the chair is stationary, and to comfortably support the person's feet when the person is seated within the chair, while the chair is being moved from one location to another location, such that the person's feet do not engage the floor. A still further overall objective of the present invention is to provide a new and improved chair/chair base wherein a foot support is operatively mounted upon the chair, and wherein the foot support is movable between a retracted or stowed position beneath the chair, and an extended or deployed position extending outwardly from the front of the chair, so as to comfortably support a person's feet when the person is seated within the chair while the chair is stationary, and to comfortably support the person's feet when the person is seated within the chair, while the chair is being moved from one location to another location, such that the person's feet do not engage the floor whereby the person's feet will not interfere with or impede the movement of the chair along the floor as it is moved from one location to another location.

SUMMARY OF THE INVENTION

The foregoing and other objectives of the present invention are achieved by a new and improved chair having a chair base with a retractable foot support wherein the chair base comprises a base framework which comprises a pair of oppositely disposed forward and rearward, transversely extending frame members, and a pair of oppositely disposed left and right side, longitudinally extending frame members that are fixedly connected to the forward and rearward, transversely extending frame members within the vicinity of the corner regions of the base framework whereby it is seen that the base framework has a substantially rectangular or square configuration. A plurality of caster-type wheels are provided beneath the four corner regions of the base framework so as to enable the chair to be readily and easily moved or ambulatory along a floor or platform upon which the chair is supported. In addition, a pair of transversely extending, longitudinally spaced, forward and rearward cross-beam members have their opposite ends fixedly mounted upon the pair of oppositely disposed left and right side, longitudinally extending frame members, and a pair of transversely spaced, longitudinally extending track members have their opposite ends fixedly mounted upon the rearward, transversely extending cross-beam member and the forward, transversely extending frame member such that intermediate portions of the pair of transversely spaced, longitudinally extending track members are disposed or pass beneath the forward, transversely extending cross-beam member.

Still further, a foot support, which may comprise a support plate, a tray, a shelf, or a similar platform, is mounted upon a foot support framework which comprises a pair of transversely spaced, longitudinally extending foot support frame members, and a transversely oriented foot support cross-beam frame member. A pair of rollers or wheels are respectively mounted upon each one of the pair of transversely spaced, longitudinally extending foot support frame members, and are adapted to be rotatably disposed within or upon the pair of transversely spaced, longitudinally extending track members. Still further, a linear actuator has its motor end operatively connected to the rearward, transversely extending frame member, while its telescopic rod end is operatively connected to the transversely oriented foot support cross-beam frame member. Lastly, one of the pair of transversely spaced, longitudinally extending foot support frame members is provided with a pair of upstanding, longitudinally spaced, forward and rearward stop members which are adapted to respectively engage the pair of transversely extending, longitudinally spaced, forward and rearward cross-beam members. As will become more readily apparent from the following detailed description, when the linear actuator is actuated so as to extend or deploy the retractable foot support from its stowed or retracted position beneath the chair base framework toward the fully extended or deployed position, the retractable foot support will be moved toward the fully extended or deployed position which is defined by or limited as a result of the forward, upstanding stop member encountering the forward cross-beam member. Conversely, when the linear actuator is actuated so as to retract the retractable foot support from its fully extended or deployed position back to its fully stowed or retracted position beneath the chair base framework, the retractable foot support will be moved toward the fully retracted or stowed position which is defined by or limited as a result of the rearward, upstanding stop member encountering the rearward cross-beam member.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
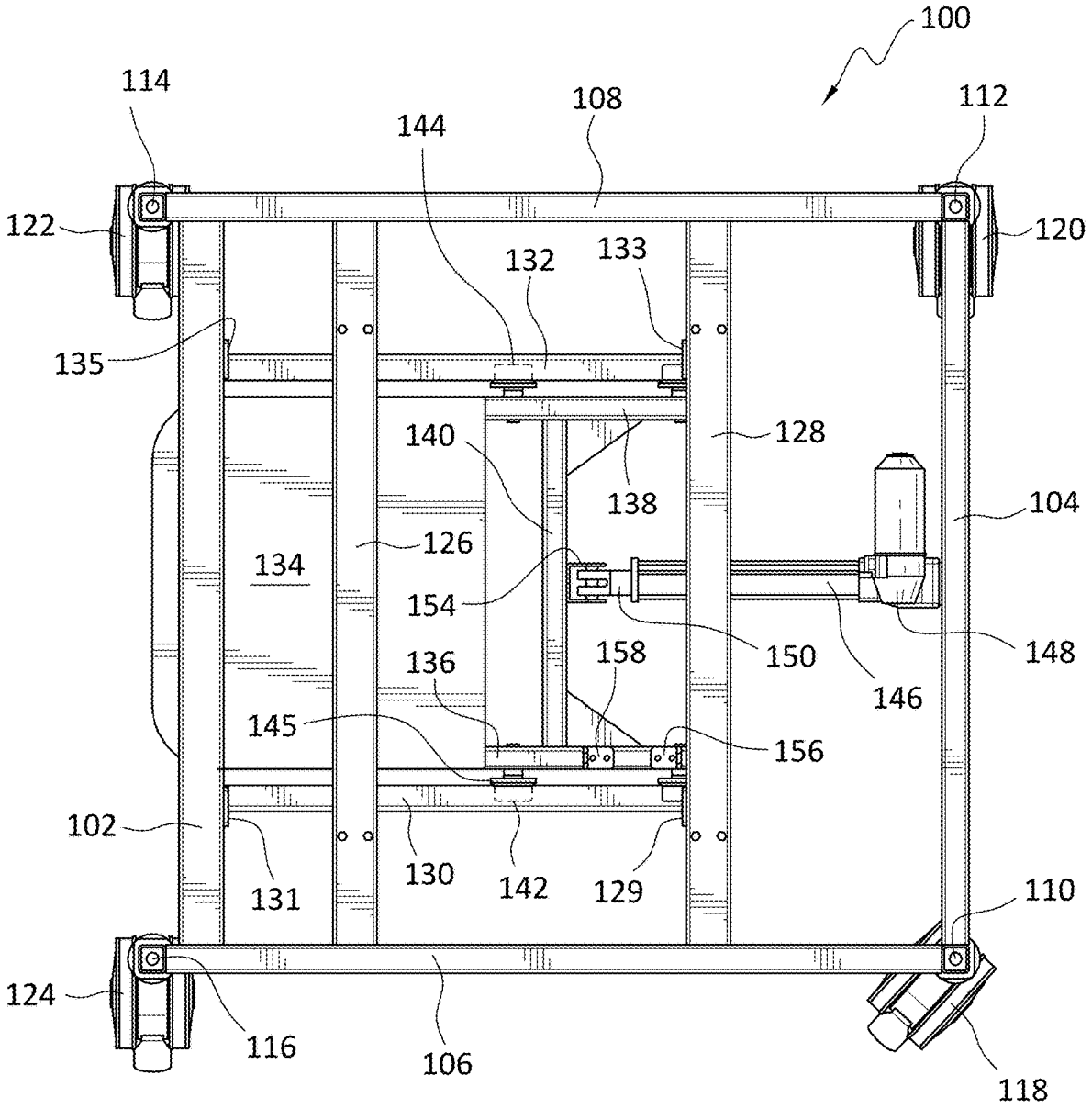
FIG. 1 is a schematic, top plan view of the new and improved chair base, with a retractable foot support, as developed in accordance with the principles and teachings of the present invention, and wherein the foot support is shown as being at its stowed or retracted position.
Figure 2:
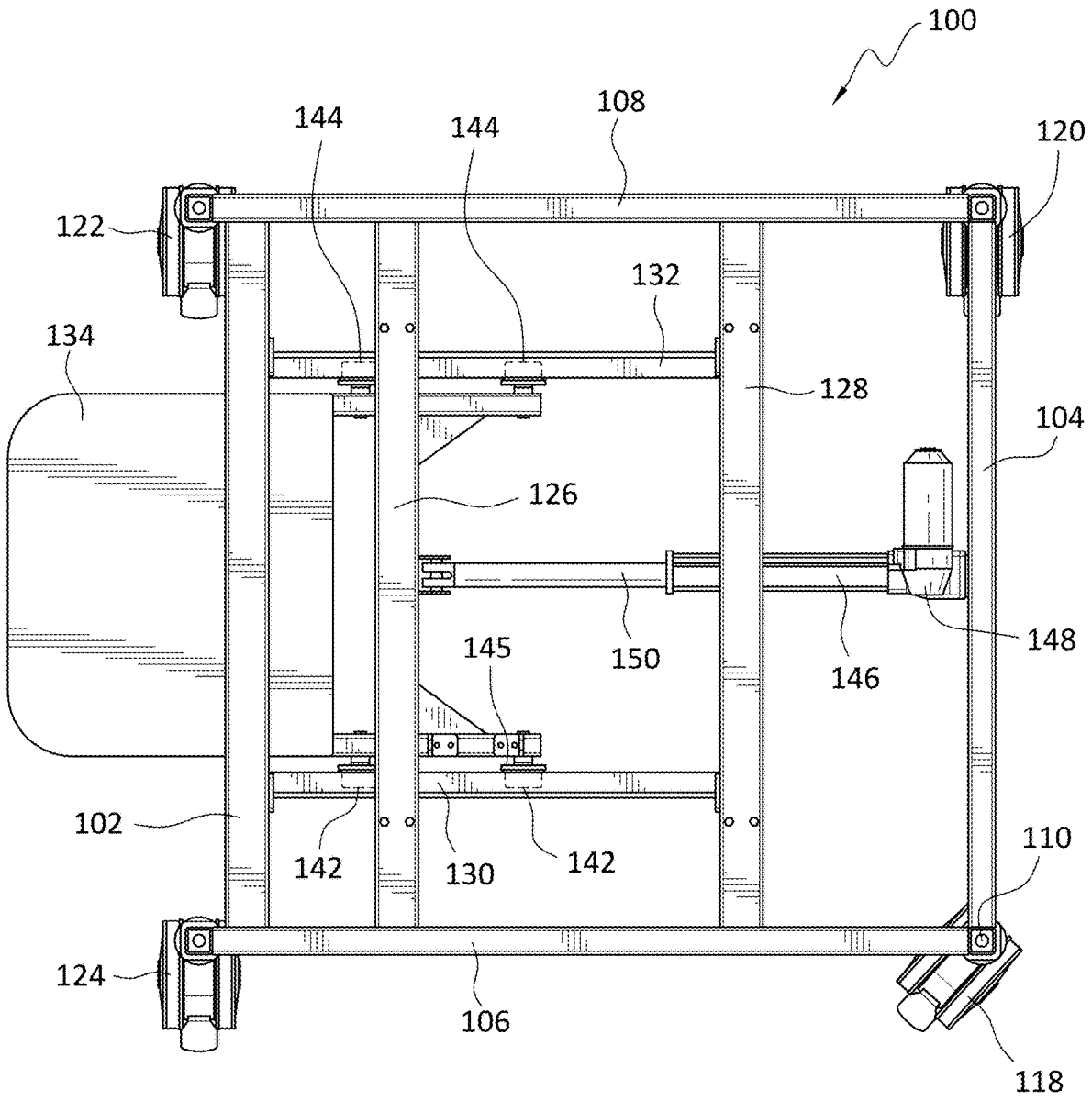
FIG. 2 is a schematic, top plan view of the new and improved chair base, with a retractable foot support, similar to that of FIG. 1, wherein, however, the foot support is shown as being at its deployed or extended position.
Figure 3:
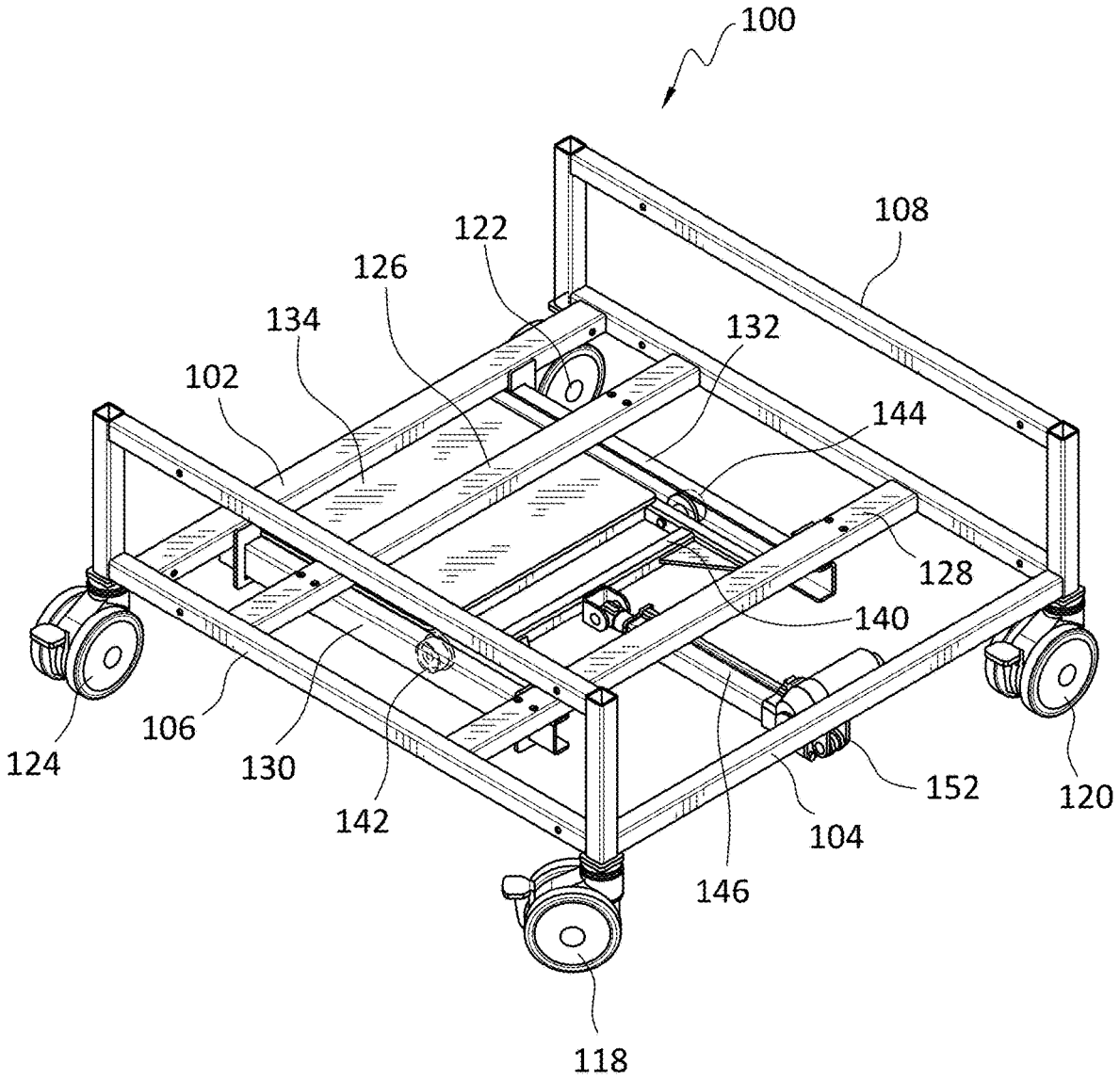
FIG. 3 is a perspective view of the new and improved chair base, with a retractable foot support, corresponding to that of FIG. 1, wherein the foot support is shown as being at its retracted or stowed position.
Figure 4:
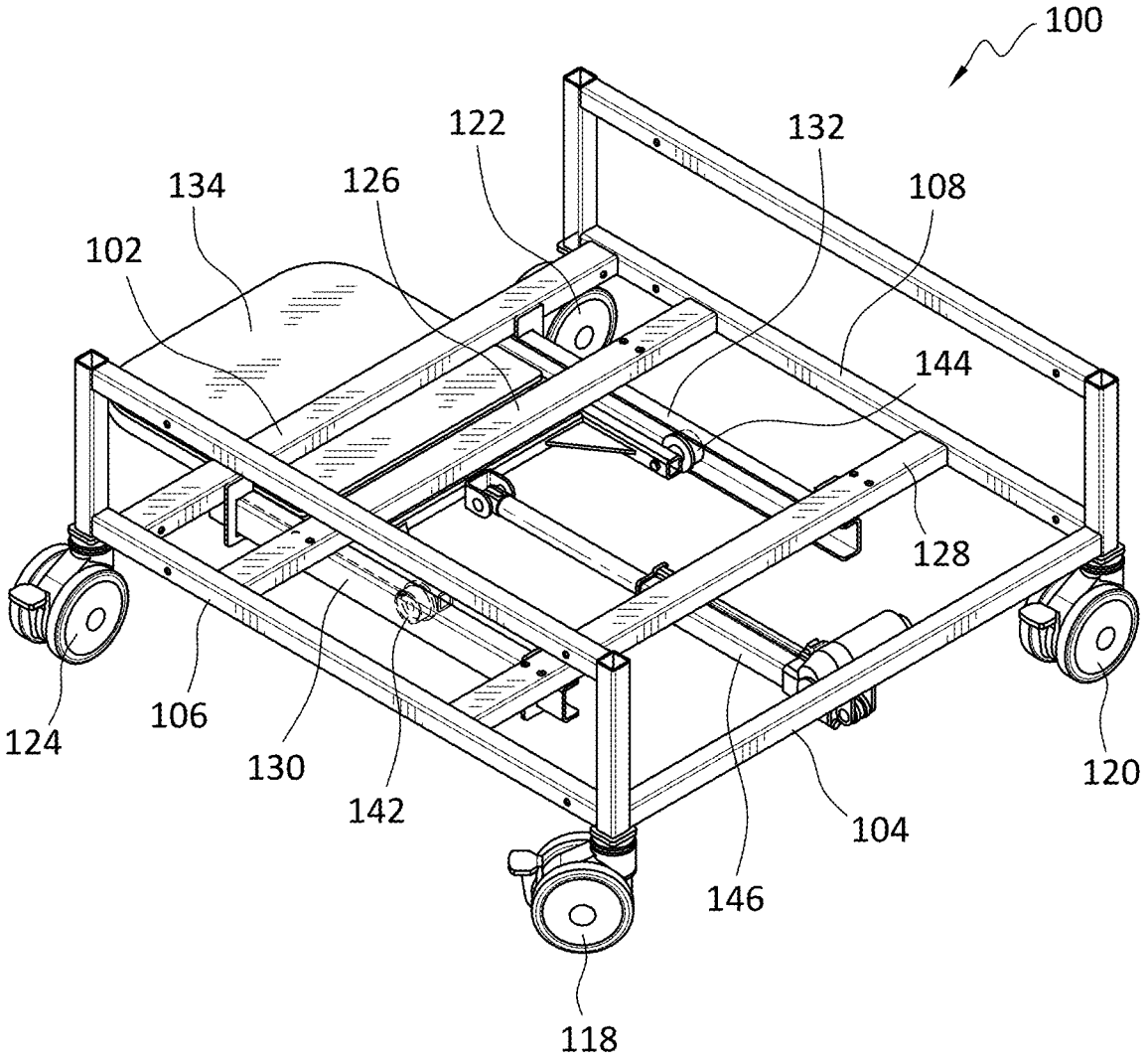
FIG. 4 is a perspective view of the new and improved chair base, with a retractable foot support, corresponding to that of FIG. 2, wherein the foot support is shown as being at its deployed or extended position.

With reference now being made to the drawings, and more particularly to FIGS. 1-4 thereof, a new and improved chair base, with a retractable foot support, is disclosed and is generally indicated by the reference character 100. More particularly, it is seen that the new and improved chair base 100, with the retractable foot support, comprises a base framework which comprises a pair of oppositely disposed forward and rearward, transversely extending frame members 102,104, and a pair of oppositely disposed left and right side, longitudinally extending frame members 106, 108 that are fixedly connected to the forward and rearward, transversely extending frame members 102, 104 within the vicinity of the corner regions 110, 112, 114, 116 of the base framework whereby it is seen that the base framework has a substantially rectangular or square configuration. A plurality of caster-type wheels 118, 120, 122, 124 are provided beneath the four corner regions 110, 112, 114, 116 of the base framework so as to enable the chair to be readily and easily moved along a floor or platform upon which the chair is supported. In addition, a pair of transversely extending, longitudinally spaced, forward and rearward cross-beam members 126, 128, interposed between the pair of oppositely disposed forward and rearward, transversely extending frame members 102,104, have their opposite ends fixedly mounted upon the pair of oppositely disposed left and right side, longitudinally extending frame members 106, 108, and a pair of transversely spaced, longitudinally extending track members 130, 132 have their opposite ends fixedly mounted upon or connected to the rearward, transversely extending cross-beam member 128 and the forward, transversely extending frame member 102, as at 129, 131, 133, 135, such that intermediate portions of the pair of transversely spaced, longitudinally extending track members are disposed, or pass, beneath the forward, transversely extending cross-beam member 126.

Still further, a foot support 134, which may comprise a support plate, a tray, a shelf, or a similar platform, is mounted upon a foot support framework which comprises a pair of transversely spaced, longitudinally extending foot support frame members 136, 138, and a transversely oriented foot support cross-beam frame member 140. A pair of rollers or wheels 142, 144 are respectively mounted upon each one of the pair of transversely spaced, longitudinally extending foot support frame members 136,138, and are adapted to be rotatably disposed within or upon the pair of transversely spaced, longitudinally extending track members 130, 132. It is noted that each one of the rollers or wheels 142,144 is provided with an enlarged, internal flanged portion 145 which is adapted to engage an inner edge portion of each track member 130, 132 such that, once assembled, the rollers or wheels 142, 144 will automatically maintain themselves engaged with the track members 130, 132, and cannot be readily disengaged from the track members 130, 132. Still further, a linear actuator 146 has its motor end 148 operatively connected to the rearward, transversely extending frame member 104, while its telescopic rod end 150 is operatively connected to the transversely oriented foot support cross-beam frame member 140. Both ends 148, 150 of the linear actuator 146 may be operatively connected to their respective frame members 104, 140 by suitable clevis connectors 152, 154. It is lastly seen that one of the pair of transversely spaced, longitudinally extending foot support frame members, such as, for example, foot support frame member 136, is provided with a pair of upstanding, longitudinally spaced, forward and rearward stop members 156, 158 which are adapted to respectively engage the pair of transversely extending, longitudinally spaced, forward and rearward cross-beam members 128, 126 when the retractable foot support 134 is moved from its stowed or retracted position beneath the chair base framework, and its fully extended or deployed position at which the retractable foot support 134 projects outwardly from the front of the chair framework.

Having described substantially all of the operative components of the new and improved chair base 100, a brief description of the operation of the same will now be provided. More particularly, when it is desired to move the retractable foot support 134 from its stowed or retracted position beneath the chair base framework, as disclosed within FIGS. 1 and 3, to a position at which the retractable foot support 134 is disposed at its fully extended or deployed position, as illustrated within FIGS. 2 and 4, at which the retractable foot support 134 projects outwardly from, and is disposed in front of, the chair base framework, the linear actuator 146 will be actuated whereby the telescopic rod end 150 of the linear actuator 146 will be extended so as to cause the retractable foot support 134 to in fact be moved from its stowed or retracted position beneath the chair base framework, as disclosed within FIGS. 1 and 3, to a position at which the retractable foot support 134 is disposed at its fully extended or deployed position, as illustrated within FIGS. 2 and 4, at which the retractable foot support 134 projects outwardly from, and is disposed in front of, the chair base framework. The full extent to which the retractable foot support 134 can in fact be extended is effectively defined by or limited as a result of the forward, upstanding stop member 158 encountering the forward cross-beam member 126. Conversely, when the linear actuator 146 is actuated so as to retract the retractable foot support 134 from its extended or deployed position back to its stowed or retracted position beneath the chair base framework, the retractable foot support 134 will be moved toward the fully retracted or stowed position which is defined by or limited as a result of the rearward, upstanding stop member 156 encountering the rearward cross-beam member 128.

Obviously, many variations and modifications of the present invention are possible in light of the above teachings. It is therefore to be understood that within the scope of the appended claims, the present invention may be practiced otherwise than as specifically described herein.

What is claimed is:

1. A chair base having a retractable foot support, comprising:

a chair base framework comprising a pair of transversely extending, longitudinally spaced forward and rearward frame members, and a pair of longitudinally extending, transversely spaced left and right side frame members fixedly connected to said pair of transversely extending, longitudinally spaced forward and rearward frame members;

a pair of transversely extending, longitudinally spaced, forward and rearward cross-beam members interposed between said pair of transversely extending, longitudinally spaced forward and rearward frame members and fixedly connected to said pair of longitudinally extending, transversely spaced left and right side frame members fixedly connected to said pair of transversely extending, longitudinally spaced forward and rearward frame members;

a pair of transversely spaced, longitudinally extending track members having their opposite ends fixedly mounted upon or connected to said rearward, transversely extending cross-beam member and said forward, transversely extending frame member;

a retractable foot support mounted upon said pair of transversely spaced, longitudinally extending track members so as to be movable between a retracted position and an extended position, wherein said retractable foot support can support a person's feet when the person is seated within a chair which is supported by said chair base framework; and a linear actuator operatively connected to said retractable foot support for moving said retractable foot support between said retracted and extended positions.

2. The chair base as set forth in claim 1, wherein:

said pair of transversely extending, longitudinally spaced forward and rearward frame members are connected to said pair of longitudinally extending, transversely spaced left and right side frame members such that said chair base framework has a substantially rectangular configuration.

3. The chair base as set forth in claim 2, wherein:

said pair of transversely extending, longitudinally spaced forward and rearward frame members are connected to said pair of longitudinally extending, transversely spaced left and right side frame members at corner regions of said chair base framework.

4. The chair base as set forth in claim 3, further comprising:

a plurality of caster wheels mounted upon said corner regions of said chair base framework so as to permit said chair base framework to be ambulatory.

5. The chair base as set forth in claim 1, wherein:

said linear actuator comprises a telescopic rod which is operatively connected to said retractable foot support so as to move said retractable foot support along said pair of transversely spaced, longitudinally extending track members between said retracted and extended positions when said telescopic rod of said linear actuator is moved between extended and retracted positions.

6. The chair base as set forth in claim 5, wherein:

said retractable foot support is fixedly mounted upon a foot support framework; and a plurality of rollers or wheels are mounted upon said foot support framework and are adapted to be engaged with said pair of transversely spaced, longitudinally extending track members so as to permit said retractable foot support to move along said pair of transversely spaced, longitudinally extending track members, between said extended and retracted positions, when said telescopic rod of said linear actuator is moved between extended and retracted positions.

7. The chair base as set forth in claim 6, further comprising:

a pair of forward and rearward stop members mounted upon said foot support framework for engaging said pair of transversely extending, longitudinally spaced, forward and rearward cross-beam members so as to thereby define said extended and retracted positions of said retractable foot support.

8. A chair having a chair base, comprising:

a chair base framework comprising a pair of transversely extending, longitudinally spaced forward and rearward frame members, and a pair of longitudinally extending, transversely spaced left and right side frame members fixedly connected to said pair of transversely extending, longitudinally spaced forward and rearward frame members;

a pair of transversely extending, longitudinally spaced, forward and rearward cross-beam members interposed between said pair of transversely extending, longitudinally spaced forward and rearward frame members and fixedly connected to said pair of longitudinally extending, transversely spaced left and right side frame members fixedly connected to said pair of transversely extending, longitudinally spaced forward and rearward frame members;

a pair of transversely spaced, longitudinally extending track members having their opposite ends fixedly mounted upon or connected to said rearward, transversely extending cross-beam member and said forward, transversely extending frame member;

a retractable foot support mounted upon said pair of transversely spaced, longitudinally extending track members so as to be movable between a retracted position and an extended position, wherein said retractable foot support can support a person's feet when the person is seated within a chair which is supported by said chair base framework; and a linear actuator operatively connected to said retractable foot support for moving said retractable foot support between said retracted and extended positions.

9. The chair as set forth in claim 8, wherein:

said pair of transversely extending, longitudinally spaced forward and rearward frame members are connected to said pair of longitudinally extending, transversely spaced left and right side frame members such that said chair base framework has a substantially rectangular configuration.

10. The chair as set forth in claim 9, wherein:

said pair of transversely extending, longitudinally spaced forward and rearward frame members are connected to said pair of longitudinally extending, transversely spaced left and right side frame members at corner regions of said chair base framework.

11. The chair as set forth in claim 10, further comprising:

a plurality of caster wheels mounted upon said corner regions of said chair base framework so as to permit said chair base framework to be ambulatory.

12. The chair as set forth in claim 8, wherein:

said linear actuator comprises a telescopic rod and is operatively connected to said retractable foot support so as to move said retractable foot support along said pair of transversely spaced, longitudinally extending track members between said retracted and extended positions when said telescopic rod of said linear actuator is moved between extended and retracted positions.

13. The chair as set forth in claim 12, wherein:

said retractable foot support is fixedly mounted upon a foot support framework; and a plurality of rollers or wheels are mounted upon said foot support framework and are adapted to be engaged with said pair of transversely spaced, longitudinally extending track members so as to permit said retractable foot support to move along said pair of transversely spaced, longitudinally extending track members, between said extended and retracted positions, when said telescopic rod of said linear actuator is moved between extended and retracted positions.

14. The chair as set forth in claim 13, further comprising:

a pair of forward and rearward stop members mounted upon said foot support framework for engaging said pair of transversely extending, longitudinally spaced, forward and rearward cross-beam members so as to thereby define said extended and retracted positions of said retractable foot support.

* * * * *